US007362663B2

(12) United States Patent
Kagan

(10) Patent No.: US 7,362,663 B2
(45) Date of Patent: Apr. 22, 2008

(54) ELAPSED TIME INDICATOR DEVICE

(75) Inventor: Michael Kagan, Jerusalem (IL)

(73) Assignee: Timestrip UK Limited, Middlesex (GB)

( * ) Notice: Subject to any disclaimer, the term of this patent is extended or adjusted under 35 U.S.C. 154(b) by 50 days.

(21) Appl. No.: 11/230,893

(22) Filed: Sep. 21, 2005

(65) Prior Publication Data

US 2007/0064541 A1 Mar. 22, 2007

(51) Int. Cl.
*G04F 1/00* (2006.01)

(52) U.S. Cl. ..... 368/327; 116/200

(58) Field of Classification Search ..... 368/114, 368/327; 116/200
See application file for complete search history.

(56) References Cited

U.S. PATENT DOCUMENTS 4,804,275 A * 2/1989 Kang et al. ..... 374/162
5,802,015 A 9/1998 Rothschild et al.
6,243,192 B1 * 6/2001 Mitchell et al. ..... 359/270
6,335,692 B1 1/2002 Compton
2006/0227669 A1 * 10/2006 Pennaz et al. ..... 368/327

FOREIGN PATENT DOCUMENTS

WO WO 00/73859 A1 12/2000
WO WO 01/82004 A1 11/2001

* cited by examiner

*Primary Examiner*—P. Austin Bradley
*Assistant Examiner*—Thanh S Phan
(74) *Attorney, Agent, or Firm*—Breiner & Breiner, LLC

(57) ABSTRACT

The invention provides an electronic printed chromatic elapsed time indicator device comprising a switch, a power source and a power driven elapsed time display for indicating the elapse of a limited predetermined segment of time upon activation of the switch and irrespective of the actual time of activation thereof, wherein the components are functionally interconnected and are printed on at least one substrate.

11 Claims, 8 Drawing Sheets

ELAPSED TIME INDICATOR DEVICE

BACKGROUND

The present invention relates to an electronic printed chromatic elapsed time indicator device and to a method of indicating the elapse of a predetermined period of time. More specifically the present invention pertains to a solid state electrical device that measures and visually indicates the passage of a predetermined period of time and the various components of which can be formed by inexpensive printing methods and by lamination of the layers, which can be activated at point of use.

Many devices are known for measuring and displaying the elapse of predetermined periods of time such as hour glasses, mechanical stop watches, electronic stop watches, and liquid-diffusion time indicator devices. A need exists for an elapsed time measuring device that is electronic, solid state, reliable, easy to manufacture and inexpensive (less than 10 US cents). In particular there is a need for such devices in which the consumer activates the timing mechanism independent of the actual time and which will inform the consumer of the progress and elapse of a predetermined segment of time, for example, to signal users of glues and adhesives such as Solvite that requires a bonding process of at least 20 minutes before it takes effect. Another example is in food safety. Regulations require that during the preparation of cooked items uncooked ingredients must not remain unrefrigerated for more than four hours. A further example is in health care where various components in a catheter arrangement such as the manifold and bacteria filter need to be replaced within a specified period of time. Keeping track of such time segments can be confusing and can lead to errors and oversights by working staff. A device as described herein is therefore of value in notifying the consumer of the elapsed time from time of activation independent of actual time of a large variety of time dependable consumerables.

SUMMARY

Thus according to the present invention there is now provided an electronic printed chromatic elapsed time indicator device comprising a switch, a power source and a power driven elapsed time display for indicating the elapse of a limited predetermined segment of time upon activation of said switch and irrespective of the actual time of activation thereof, wherein said components are functionally interconnected and are printed on at least one substrate. In a preferred embodiment of the present invention said electronic printed chromatic elapsed time indicator device further comprises a controlling electronic circuit for controlling said display.

In some preferred embodiments of the present invention said electronic printed chromatic elapsed time indicator device incorporates a thermochromic display.

In other preferred embodiments of the present invention said electronic printed chromatic elapsed time indicator device incorporates an electrochromic display.

In preferred embodiments of the present invention said controller, power source, and the contents for said switch are integrated on to at least one polymer substrate.

In further preferred embodiments of the present invention said display displays progressive time increments.

In other preferred embodiments of the present invention at the elapse of a predetermined time period, said display provides a clear indication that this period has elapsed.

Preferably said device further comprises means for indicating that the device has been activated.

In some preferred embodiments of the present invention said power source, said switch and said display are all printable.

In other preferred embodiments of the present invention said power source, said switch, said controlling electronic circuit and said display are all printable.

In another aspect of the present invention there is provided a method for enabling a consumer to activate a consumer product at a time of use, independent of date of manufacture, date of sale and independent of actual time of activation, and to be apprised of elapsed time from such activation, comprising providing an electronic printed chromatic elapsed time indicator device comprising a switch, a power source and a power driven elapsed time display for indicating the elapse of a limited predetermined segment of time upon activation of said switch and irrespective of the actual time of activation thereof, wherein said components are functionally interconnected and are printed on at least one substrate and wherein said switch is adapted to be activated by the consumer at time of use.

Thus according to an aspect of the invention, an indicator device of elapsed predetermined time, includes a power source, a switch that will activate the predetermined time mechanism, a display such that a user will be given regular indications of the elapse of the predetermined period of time, and a controlling electronic circuitry that controls the display.

In U.S. Pat. No. 5,555,223 there is described and claimed a process for producing or packing an item with a limited period of use or interest, which item includes a timer providing a display and an energy source. However, said patent is specifically directed and limited to an item wherein the timer is set and/or configured so that its display is synchronized with the actual time and at the same time there is an indication of the time of production, While the present invention is directed to an elapsed time indicator device designed for use by a consumer who activates the device upon use and the display of elapsed time is a function of activation, irrespective of the actual time of activation.

In U.S. Pat. No. 5,802,015 there is described and claimed an electronic timing label for indicating the expiration of a time period associated with an article, however, said timing label involves the use of multiple components which are physically affixed rather than printed on a substrate.

Similarly in U.S. Pat. No. 6,337,836 there is described and claimed a programmable electronic label, however, this device is designed for providing a signal at a selectively predetermined date and time and includes a real time clock circuit, as opposed to the present invention which is directed to an elapsed time indicator device designed for use by a consumer who activates the device upon use and the display of elapsed time is a function of activation, irrespective of the actual time of activation.

In U.S. Pat. No. 6,667,936 there is described and claimed a timer device for disposition atop of a prescription container cap on a drug container, which includes a timer device having an electronic timer circuit, however, said patent is limited to a device which includes a separate electric battery and other physical components and does not teach or suggest the simple and inexpensive device of the present invention in which the components are functionally interconnected and printed on a substrate.

In U.S. Pat. No. 3,968,639 there is described and claimed an electronic device for visually indicating accumulated electric current flow and including an electrochromic information display, however, the battery described therein is a liquid battery and not a printed power source.

The major advantages of this timer compared to other timers is that it is easy to manufacture, is very thin and flexible, uses very small amounts of current, provides a clear visual display, and is easily calibrated at point-of-manufacture to a wide range of predetermined times. The ease of manufacture and the low costs of materials and manufacturing processes allow this time elapse indicator device to be a disposable element supplied in conjunction with a particular product that requires the consumer to be aware of the passage of time and to be informed of the conclusion of a predetermined time period.

The predetermined time elapse indicator device includes a means of displaying the passage of time such that a user will informed not only of the conclusion of the predetermined period of time but also of divisions of this time so as to gain an awareness of what fraction of the predetermined time period has elapsed and what fraction of the predetermined time period has yet to elapse. The display can be of a type that is directly controlled by the current or voltage from the power source or the display can be of a type that is indirectly influenced by a secondary effect resulting by the passage of electricity through the circuit.

It is the object of this invention to combine each of these four elements, namely the power source, the switch, the controller, and the display into one body whose thickness is comparable to that of a credit card and whose area is about a fourth of the area of a regular business card.

It is a further object of this invention to provide a predetermined elapsed time indicator device that is capable of being manufactured at a cost of less than 10 US cents.

It is a further object of this invention to provide a predetermined elapsed time indicator device that is triggered by the user at the moment of use.

It is yet a further object of this invention that the display, the controller, the battery and the contacts for the switch be integrated onto at least one polymer substrate.

It is yet a further object of this invention that the display displays progressive time increments in a way that is easily understood and that at the elapse of the predetermined time period, the user has a clear indication that this time period has elapsed.

It is still a further objective of this invention that an indication be given to the user signaling that the device has been successfully activated.

It is a further objective of this invention that the various components be housed in a laminated package.

In the preferred embodiment, the power source, the switch, the controller, and the display are printable.

DETAILED DESCRIPTION OF THE DRAWINGS

Figure 1:
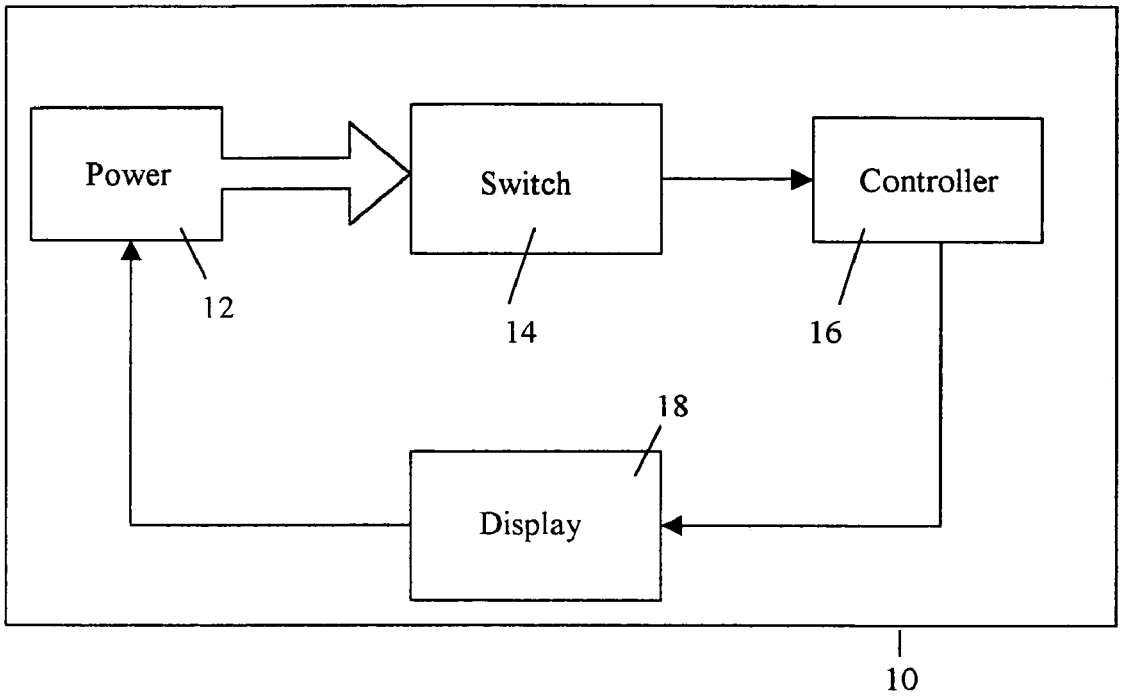
FIG. 1 is a schematic representation of the discrete elements comprising the predetermined time elapse indicator device.

Referring now to FIG. 1, a predetermined time elapse indicator device 10 consists of a power source 12 connected to a switching device 14. The switching mechanism 14 is of the type 'on/stay-on' such that upon activation the elapse of the predetermined time is commenced. Activation of the switching mechanism 14 causes the current from the power source 12 to flow to the controlling unit 16. The controlling unit 16 determines the flow of current from the power source 12 to the display 18 in such a manner as to ensure that the predetermined time of the predetermined time elapse indicator device 10 is proportioned uniformly to the display 18.

The predetermined time elapse indicator device 10 comprises the above mentioned four components. It is an objective of this invention that each of these components be printable, low cost, and contained within a package that is thin and compact. Thus the power source 12 can be of the form of a printed paper battery such as manufactured by Solicore, Inc. Lakeland, Fla., Power Paper Ltd, Israel, Thin Battery Technologies, Inc. Ohio. Such a power source 12 can be constructed using, by way of example only, a zinc cathode that is deposited by means such as printing, stamping, and spluttering, and a manganese dioxide anode that is deposited by means such as printing and stamping, and an electrolyte such as zinc chloride and ammonium chloride contained within a solid or semi-solid matrix such as a gel and polymer as is known to one skilled in the art.

The switch 14 can be any means that creates a permanent connection between two electrical contacts. Such a switching mechanism 14 can be actualized by such methods as a pull-out tag, as described in U.S. Pat. No. 6,667,936, a collapsible metallic blister, a sticky membrane switch and by the use of transistors in an arrangement of printed transistors. Furthermore the switch can be triggered by indirect means such as described in U.S. Pat. No. 6,373,786 in which the action by a consumer such as but not limited to opening a package, twisting a cap and unfolding a label initiates the switching mechanism 14.

The controller 16 serves to partition the flow of electricity to the display into discrete portions of the predetermined time. A number of methods are known to one skilled in the art, including the use of printed resistors, printed resistor/capacitor oscillators as disclosed in U.S. Pat. No. 6,456,169, printed transistors as disclosed in U.S. Pat. No. 6,806,511, and printed diodes as disclosed in U.S. Pat. No. 6,291,096. The duration of the predetermined time is determined by the choice of components comprising the controller 16 and the power drainage on the power source.

Figure 8:
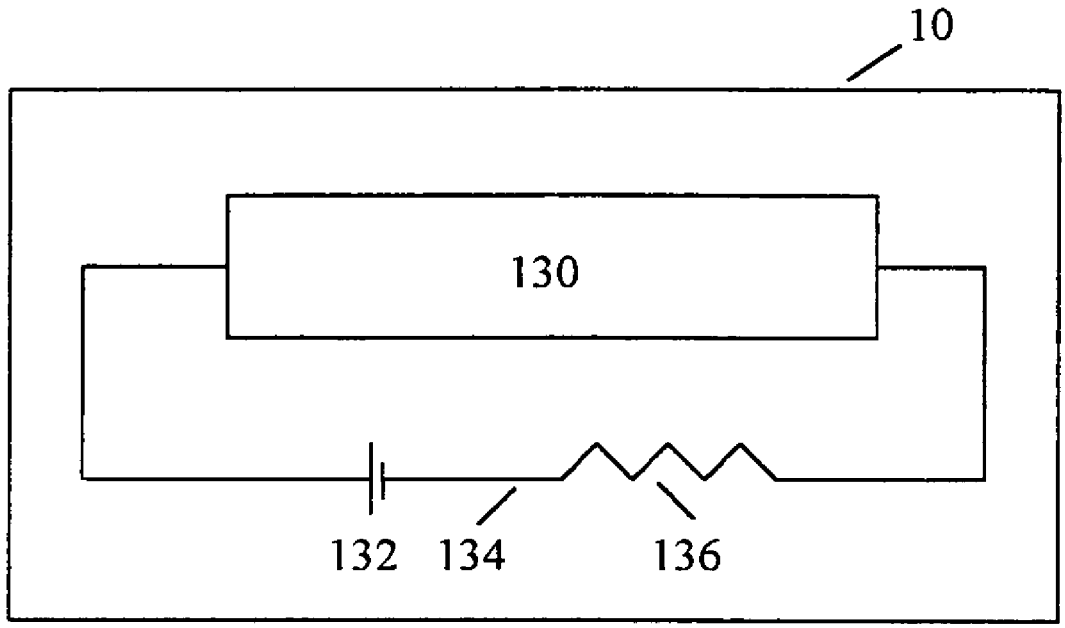
FIG. 8 is a schematic representation of an electrical circuit and a continuous display.

The display 18 is of a type that can be readily formed as a thin film with ultra-low energy demands. One type of device is an electrophoretic display such as made available by E-INK, Inc. Cambridge Mass. and SmartPaper provided by Gyricon, LLC. Ann Arbor, Mich. Another type of display method is a nanochromics display (NCD) provided by Ntera Ltd. Dublin, Ireland. Yet another type of display method is Organic Light Emitting Diodes (OLED) such as described in http://komar.cs.stthomas.edu/qm425/01s/Tollefsrud2.htm. Another form of OLED electrochromic display involves the use of poly(3,4-ethylenedioxythiophene) (PEDOT) with poly(styrene sulfonate) (PSS) providing the counter ion (PEDOT:PSS) provided by Acreo in Kista, Sweden. Yet another type of display method is electrochromic displays such as provided by Aveso Ltd. Fridley, Minn. A further type of display involves an indirect method such as thermochromic inks responsive to changes in temperature in an electric circuit as shown in FIG. 8. Such thermochromic inks are provided by B&H Colour Change, London England and can be of the type that is reversible and of the type that is irreversible. Such methods are well known in the art as battery testers such as those integrated into batteries provided by Duracell Inc. Bethel, Conn. and those integrated into the battery packaging provided by Eveready Battery Company, Inc. St. Louis, Mo.

Figure 2:
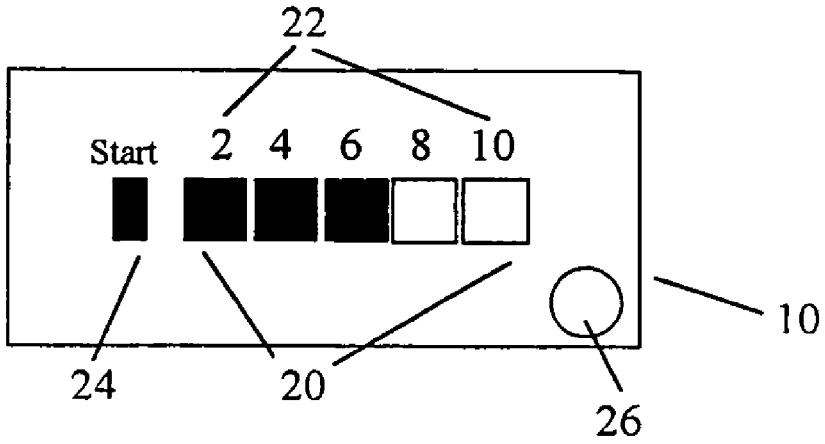
FIG. 2 is a diagrammatical view of the predetermined time elapse indicator device showing discrete pixel display.

Referring to FIG. 2, the predetermined time elapse indicator device 10 is shown from above with a display 20 segmented into pixels (picture elements) 22. Each pixel 22 represents equal subdivisions of the predetermined time. For representation reasons only, the predetermined time is set at ten minutes and the subdivisions are shown at every two minutes. A single pixel 24 indicates the start of the time elapse indicator device from the moment the user activates the predetermined time elapse indicator device 10 by means of the depression switch 26 and is a form of quality assurance notifying the user that the time elapse indicator device 10 is functional after the device has been activated by said user. It is understood that the arrangement of the pixels 22 described in FIG. 2 is for purposes of illustration only and that the invention disclosed herein is independent of the spatial arrangement of the said means of display. Thus the pixels 22 can be arranged in a circular manner or in a manner that displays information such as number segments and letters as is known to one of ordinary skill in the art. It is further understood that in the embodiment comprised of a display 20, which is segmented into pixels 22 in which the pixels are arranged in a geometrical configuration that displays numbers in a manner known in devices such as digital time pieces, the means of actualizing the display must of necessity be a reversible process.

Figure 3:
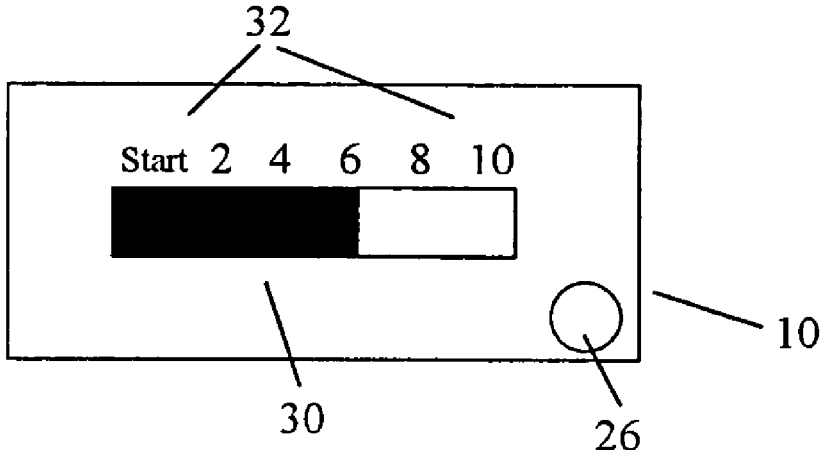
FIG. 3 is a diagrammatical view of the predetermined time elapse indicator device showing a continuous display.

In FIG. 3 the predetermined time elapse indicator device 10 is shown from above with a continuous, non-segmented display 30. In this configuration the display 30 resembles such displays as battery testers. The scale 32 is calibrated so as to coincide with the advance of the color change along the display 30. Upon activation of the switch 26 the area in the region of 'start' will immediately exhibit a color change thereby informing the user that the time elapse indicator device 10 is functional.

Figure 4:
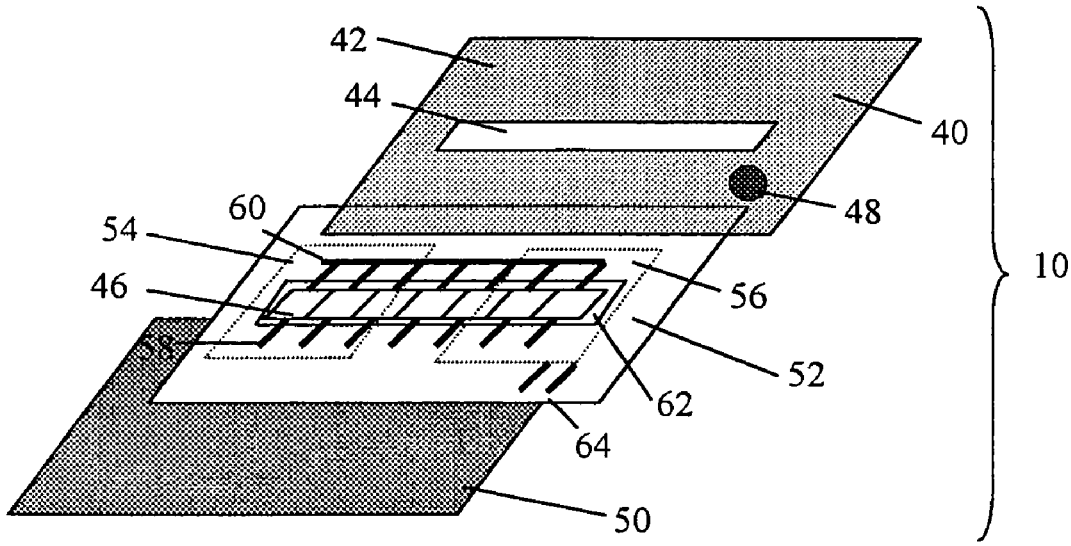
FIG. 4 is a diagrammatical exploded view of the main components of the predetermined time elapse indicator device showing a discrete electrochromic pixel display.

In FIG. 4 the various layers comprising the predetermined time elapse indicator device 10 are shown. The top layer 40 is typically a PET layer that allows for a masking print 42 with a transparent window 44 for viewing the display 46 and affords the indicator device 10 some mechanical rigidity. In this embodiment a switching mechanism 48 is located on the top layer 40. In further embodiments the switching mechanism 48 is co-located on a bottom layer 50. The switching mechanism 48 is of the type on/stay-on and in this embodiment is actualized by a sticky membrane switch. The bottom layer 50 is a laminatable material such as PVC, PET and coated aluminum. A middle layer 52 is a substrate made from a suitable non-conducting polymer such as polyester, PVC, and PET. In this embodiment the battery component 54 and the controlling components 56 are co-located on the underside of the middle layer 52. The display 46 is printed on to the upper side of the middle layer 52. In the preferred embodiment the display 46 is a segmented electrochromic display composed of a compound that undergoes a reversible redox reaction to generate a pH gradient between two sets of lateral electrodes 58 and 60 and a pH indicator device compound that changes color according to the pH as described in U.S. Pat. No. 6,879,424. In this embodiment a thin layer 62 of non-conducting polymer such as PVC is laminated over the display 46. Two contacts 64 on the middle layer 52 are co-located directly underneath the switching mechanism 48 located in the top layer 40 such that upon activating the switching mechanism 48 the two contacts 64 are bridged. The two contacts 64 comprise part of the circuitry of the controlling components 56. The three layers, that is the top layer 40, the bottom layer 50 and the middle layer 52 are laminatable by means known in the art to form a functioning predetermined time elapse indictor 10.

It is understood to one skilled in the art that the illustration in FIG. 4 does not restrict the various components to the positions illustrated such that the switching mechanism 48 can also be locatable on the bottom of layer 50 and the battery component and the controlling components can also be locatable on the upper surface of the middle layer 52. Furthermore the electrochromic display 46 is equally configurable with the electrodes 60 and 58 transverse to the display 46 and the thin layer 62 having a transparent conducting material such as ITO in contact with the electrochromic material as is known in the art.

Figure 5:
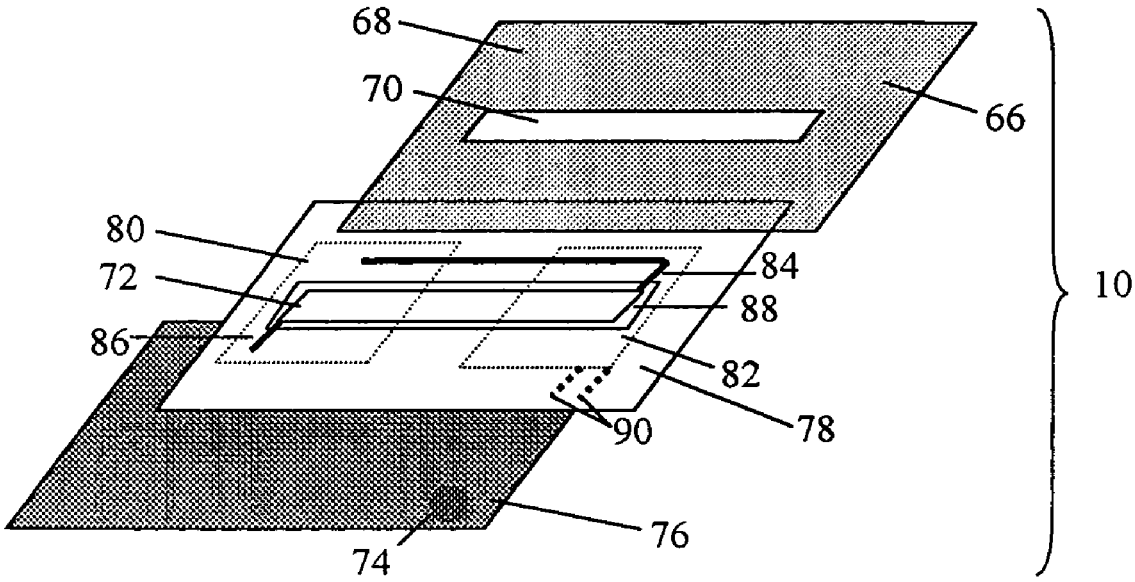
FIG. 5 is a diagrammatical exploded view of the main components of the predetermined time elapse indicator device showing a continuous electrochromic display.

Referring now to FIG. 5, the various layers comprising the predetermined time elapse indicator device 10 are shown. The top layer 66 is typically a PET layer that allows for a masking print 68 with a transparent window 70 for viewing the display 72 and affords the indicator device 10 some mechanical rigidity. In this embodiment a switching mechanism 74 is located on the bottom layer 76. The switching mechanism 74 is of the type on/stay-on and is actualized in this embodiment by a collapsible metallic blister. The bottom layer 76 is a laminatable material such as PVC, PET and coated aluminum. A middle layer 78 is a substrate made from a suitable non-conducting polymer such as polyester, PVC, and PET. In this embodiment the battery component 80 and the controlling components 82 are co-located on the underside of the middle layer 78. The display 72 is printed on to the upper side of the middle layer 78. In this alternative embodiment, the display 72 is a continuous electrochromic display composed of a compound that undergoes a reversible redox reaction to generate a pH gradient between two singular lateral electrodes 84 and 86 and a pH indicator device compound that changes color according to the pH as described in U.S. Pat. No. 6,879,424. In this embodiment a thin layer 88 of non-conducting polymer such as PVC is laminated over the display 72. Two contacts 90 on the lower side of the middle layer 78 are co-located directly above the switching mechanism 74 located in the bottom layer 76 such that upon activating the switching mechanism 74 the two contacts 64 are bridged. The two contacts 90 comprise part of the circuitry of the controlling components 82. The three layers, that is the top layer 66, the bottom layer 76 and the middle layer 78 are laminatable by means known in the art to form a functioning predetermined time elapse indictor 10.

Figure 6:
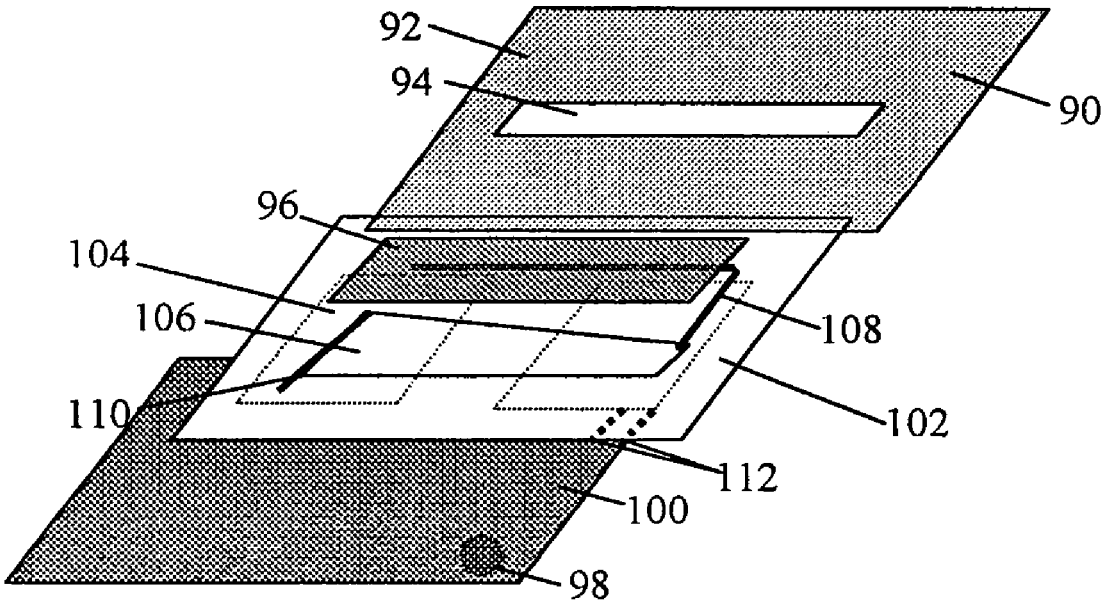
FIG. 6 is a diagrammatical exploded view of the main components of the predetermined time elapse indicator device showing a continuous thermochromic display.

In the embodiment illustrated in FIG. 6, the various layers comprising the predetermined time elapse indicator device 10 are shown. The top layer 90 is typically a PET layer that allows for a masking print 92 with a transparent window 94 for viewing a display 96 and affords the indicator device 10 some mechanical rigidity. In this embodiment a switching mechanism 98 is located on the bottom layer 100. The switching mechanism 98 is of the type on/stay-on and is actualized in this embodiment by a collapsible metallic blister. The bottom layer 100 is a laminatable material such as PVC, PET and coated aluminum. A middle layer 102 is a substrate made from a suitable non-conducting polymer such as polyester, PVC, and PET. In this embodiment the battery component 104 and the controlling components 107 are co-located on the underside of the middle layer 102. A conducting printed heat pad 106 is applied to the middle layer 102 in a wedge-shaped geometry. Inks for such conducting printable heat pads are provided by Acheson Port Huron, Mich. A mixture of carbon Electrodag 423SS and silver Electrodag 479SS printed as a thin layer results in an electrical resistance of between 35 ohms per sq. per mil to 0.02 ohms per sq. per mil. Applying an electrical potential laterally or transversely via electrodes 108 and 110 results in a temperature rise, the limit of which is a function of the resistance of the printed pad and the dissipation of heat. The wedge-shape of the printed heat pad 106 causes a differential resistivity along the length of the pad as is well known in the art of battery voltage testers such as that disclosed in U.S. Pat. No. 5,128,616. The display 96 is a continuous thermochromic overlay brought into direct contact with the heat pad 106. Such contact can be by means that include a direct print onto the upper surface of the heat pad 106 and a strip of such thermochromic material preprinted on to an inactive support material such as a thin layer of PVC and layered on to the upper surface of the heat pad 106. The thermochromic material is composed of a printable compound that undergoes a color change when heated above a predesignated temperature. As is known in the art, such a thermochromic color change can be designed as either a reversible or irreversible color change, that is the original color is recovered when the temperature falls below the predesignated temperature threshold or the color change remains permanent even if the temperature falls below the predesignated temperature threshold. In this embodiment the temperature threshold is set by the power capacity of the power source 104 but is above ambient temperature preferably at 40° C. Two contacts 112 on the lower side of the middle layer 78 are co-located directly above the switching mechanism 98 located in the bottom layer 100 such that upon activating the switching mechanism 98 the two contacts 112 are bridged. The two contacts 112 comprise part of the circuitry of the controlling components 107. The three layers, that is the top layer 90, the bottom layer 100 and the middle layer 102 are laminatable by means known in the art to form a functioning predetermined time elapse indictor 10.

Figure 7A:
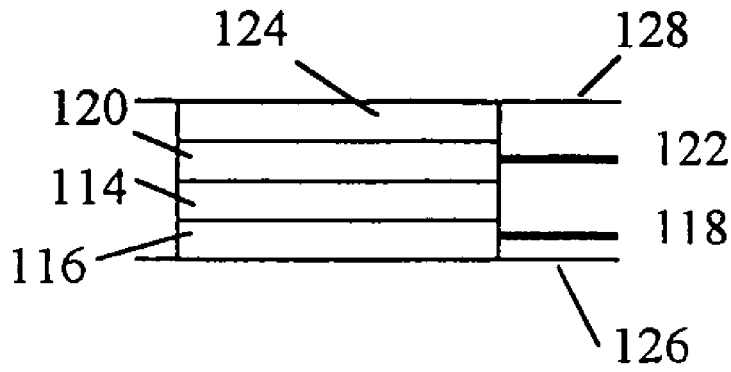
FIG. 7*a* is a representation of the various layers in a thermochromic display pixel.

FIG. 7*a* relates to an alternative embodiment of the heat pad 106 and the thermochromic display 96 as shown in FIG. 6. In this embodiment a heat pad 114, in the form of a single pixel as shown in FIG. 2, is constructed by means such as conducting carbon and silver inks, in a manner described above, and layered on to a conducting surface 116. The conducting surface 116 is made from such materials as aluminum, silver, and copper, and is attached to an electrode 118. The upper layer of the heat pad 114 is layered with a conducting surface 120 made from such materials as aluminum, silver, and copper and is attached to an electrode 122. A thermochromic ink 124, of the form described above, is layered upon this upper conducting surface 120. When an electrical potential is established between the two conducting layers 116 and 120 via the electrical electrodes 118 and 122 then the resistivity of heat pad 114 will cause an increase in temperature. The temperature is transferred through the upper conducting surface 120 to the layer of thermochromic material 124. Upon reaching a predetermined threshold temperature the thermochromic layer 124 changes color. The multilayer thermochromic display is laminated between laminatable layers 126 and 128.

Figure 7B:
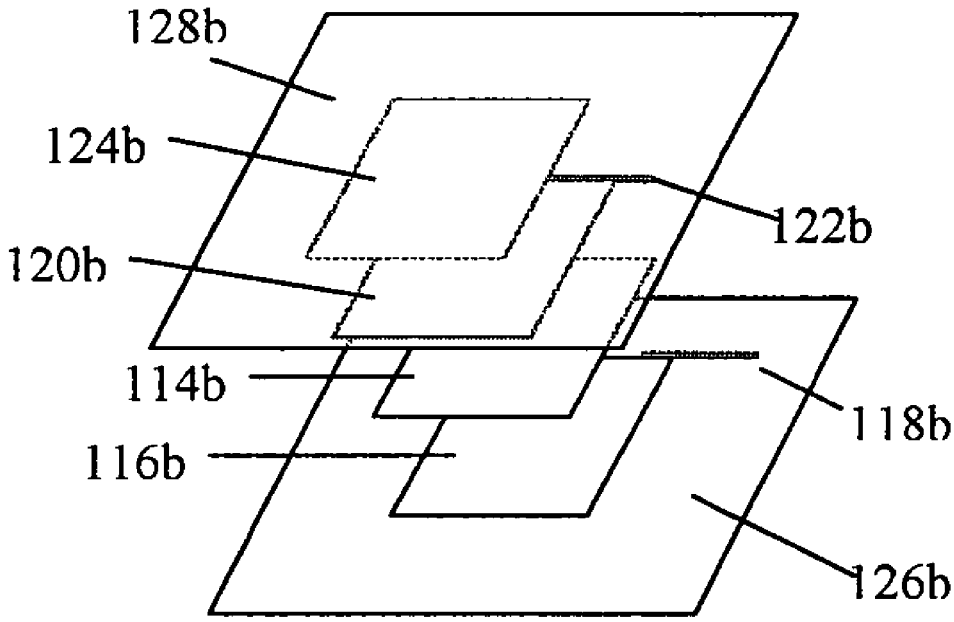
FIG. 7*b* is an exploded representation of the various layers in a thermochromic display pixel.

FIG. 7*b* shows an exploded view of the same embodiment as FIG. 7*a* and is shown for clarity with the same numbering sequence.

FIG. 8 shows by way of example a means of controlling the rate of change of appearance along a continuous display 130 according to a predetermined time. The printed power source 132 of the type already described herein is connected by printed circuitry 134 to a printed resistor 136. The printed resistor 136 is in turn connected to the continuous display 130. The continuous display 130 may be of the type described above that includes thermochromic displays and electrochromic displays. In the embodiment in which the continuous display 130 is of the thermochromic type then it is understood that the circuit described herein is via a heated pad coated with a thermochromic ink of the type described in FIG. 6. The resistance of the printed resistor 136 is chosen so as to allow the flow of electricity through the continuous display 130 at a rate that causes the continuous display 130 to change appearance in accordance with the predetermined time desired of the predetermined elapsed time indicator device 10. It is understood by one skilled in the art that the internal electrical resistance of the continuous display 130 can be sufficient to allow for calibration of the predetermined elapsed time indicator device 10. It is also understood by one skilled in the art that many methods exist to calibrate the continuous display 130 according to the predetermined time other than the means described herein.

Figure 9:
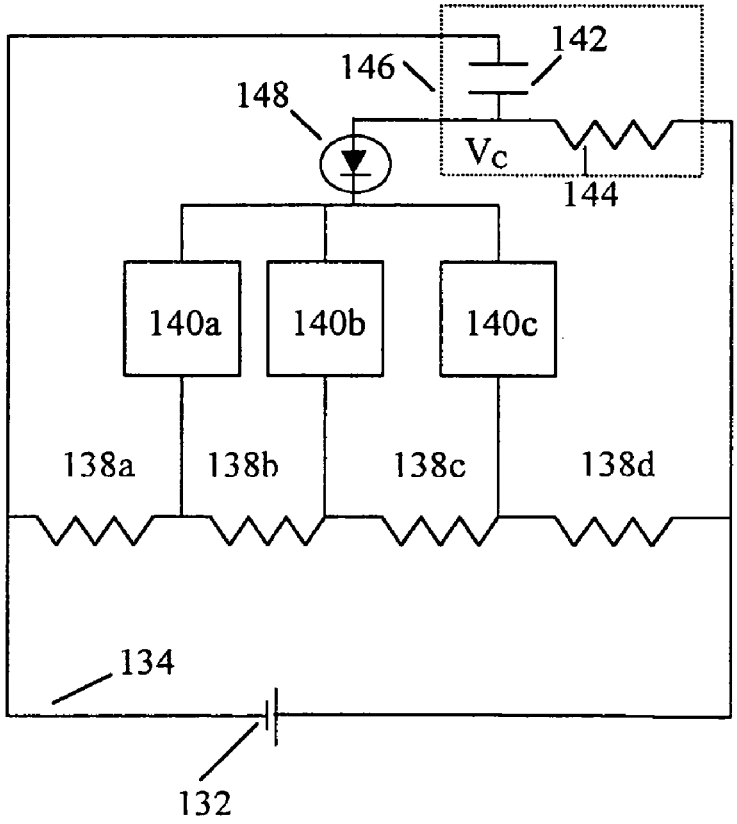
FIG. 9 is a schematic representation of an electrical circuit and an array of pixel displays.

With reference to FIG. 9, the printed power source 132 of the type already described herein is connected by printed circuitry 134 to a parallel array of printed resistors 138*a*, 138*b*, 138*c*, 138*d*. . . . The printed resistors 138*a*, 138*b*, 138*c*, 138*d* . . . are in turn connected to a parallel array of discrete pixel displays 138*a*, 138*b*, 138*c*, 138*d*. . . . The pixel displays 140*a*, 140*b*, 140*c* . . . may be of the type described above that includes thermochromic displays and electrochromic displays. In the embodiment in which the pixel displays 140*a*, 140*b*, 140*c* . . . are of the thermochromic type then it is understood that the circuit described herein is via a heated pad coated with a thermochromic ink of the type described in FIG. 7*a* and FIG. 7*b*. A printed capacitor 142 and a printed resistor 144 are in relationship to one another so as to form an RC oscillator 146. A printed diode 148 allows current to flow from the RC oscillator 146 to the discrete pixel displays 138*a*, 138*b*, 138*c*, 138*d*. . . . In such an arrangement the flow of electricity through the pixel display 140*a* will remain at zero until the electric potential built up in the RC oscillator 146 exceeds the resistance of the serial resistor 138*a*. When this point has been reached the display 140*a* will exhibit a change in appearance. Likewise display 140*b* will exhibit a change in appearance when the potential exceeds the combined resistance of resistors 138*a* and 138*b*. In order to give a user confirmation that the predetermined elapsed time indicator device 10 has been activated the resistor 138*a* is given a value of zero. Thus immediately upon activation the first display 140*a* will change appearance. If resistances of the printed resistors 138*a*, 138*b*, 138*c*, 138*d* . . . are chosen to be of equal ohmic resistance then the segmentation of the predetermined elapsed time will be of equal divisions of the voltage potential of the power supply 132. The size of the time period that the predetermined elapsed time indicator device 10 is set to measure is determined by the values of the printed capacitor 142 and printed resistor 144 of the RC oscillator 146.

It is understood by one skilled in the art that many methods exist to calibrate the array of pixel displays 140*a*, 140*b*, 140*c* . . . according to the desired predetermined time other than the means described herein. For instance it is known in the art that sequences of printed transistors can be arranged to form logic circuits. In this manner it is possible to calibrate the segment of time that the predetermined elapsed time indicator device 10 displays from minutes to months.

Figure 10:
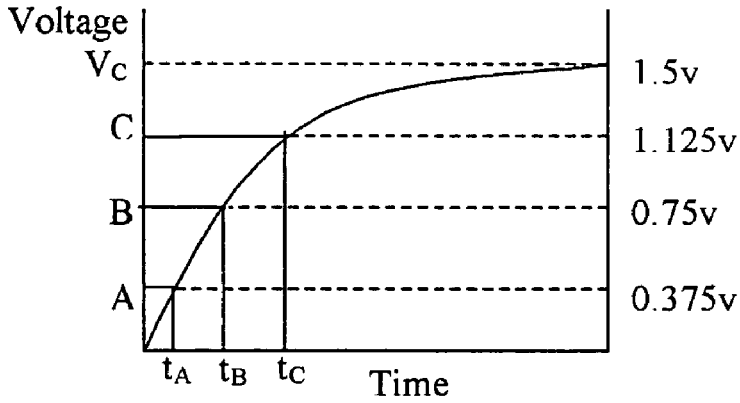
FIG. 10 is a graphic plot of the change in appearance of an array of pixel displays with time over a predetermined time period.

In FIG. 10 there is shown a graphic representation of the change in potential voltage across the point $V_C$ (y-axis) and the power source 132 in FIG. 9 with time (x-axis) due to the RC oscillator 146. When the potential difference increases to a value equal to the potential across any one of the parallel array of discrete pixel displays 140*a*, 140*b*, 140*c* . . . the current will flow through the said display thereby activating a change in appearance. For illustration purposes only, if the power source has a voltage of 1.5 volts and each of the resistors 138*a*, 138*b*, 138*c*, and 138*d* in FIG. 9 has a value of 1 MΩ then the potential across each of the discrete pixel displays 140*a*, 140*b*, 140*c* will be 0.375 volts, 0.75 volts, and 1.125 volts respectively. Therefore as the potential at the point $V_C$ reaches the value 0.375 volts the first pixel display 140*a* will change in appearance at time $t_A$. As the potential at point $V_C$ reaches a value of 0.75 volts the current will flow through the display 140*b* causing it to change in appearance at time $t_B$. As the potential at point $V_C$ reaches a value of 1.125 volts the current will flow through the display 140*c* causing it to change in appearance at time $t_C$. It is apparent that this process can be applied to any number of discrete pixel displays and in the case in which the displays are thermochromic displays then the elements 140*a*, 140*b* and 140*c* refer to discrete heat pads of the form described in FIG. 7*a* and 7*b*. In the preferred embodiment in which a user receives confirmation that the predetermined elapsed time indicator device 10 has been activated the resistor 138*a* is given a value of zero. The discrete time divisions of the predetermined elapsed time segment are determined by the values of the resistors 138*a*, 138*b*, 138*c*. . . . It is apparent that if the resistors 138*a*, 138*b*, 138*c* . . . are of equal value then the time intervals will be more or less equal only in the linear part of the curve. The values of the resistors 138*a*, 138*b*, 138*c* . . . can be calibrated to allow for the discrepancies associated with the non-linear form of the curve.

It has thus been shown that the present invention provides a device of simple construction which yet provides an effective, inexpensive, completely portable and simple means for indicating the elapse of a predetermined time period. The invention, thus, fills the need that has existed in the art of elapsed time indicating devices.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An electronic printed chromatic elapsed time indicator device comprising a switch, a power source and a power driven elapsed time display for indicating the elapse of a limited predetermined segment of time upon activation of said switch and irrespective of the actual time of activation thereof, wherein said components are functionally interconnected and are printed on at least one substrate.

2. An electronic printed chromatic elapsed time indicator device according to claim 1 further comprising a controlling electronic circuit for controlling said display.

3. An electronic printed chromatic elapsed time indicator device according to claim 1 incorporating a thermochromic display.

4. An electronic printed chromatic elapsed time indicator device according to claim 1 incorporating an electrochromic display.

5. An electronic printed chromatic elapsed time indicator device according to claim 2 wherein said controller, power source, and the contents for said switch are integrated on to at least one polymer substrate.

6. An electronic printed chromatic elapsed time indicator device according to claim 1 wherein said display displays progressive time increments.

7. An electronic printed chromatic elapsed time indicator device according to claim 1 wherein at the elapse of a predetermined time period, said display provides a clear indication that this period has elapsed.

8. An electronic printed chromatic elapsed time indicator device according to claim 1 wherein said device further comprises means for indicating that the device has been activated.

9. An electronic printed chromatic elapsed time indicator according to claim 1 wherein said power source, said switch and said display are all printable.

10. An electronic printed chromatic elapsed time indicator according to claim 2 wherein said power source, said switch, said controlling electronic circuit and said display are all printable.

11. A method for enabling a consumer to activate a consumer product at a time of use, independent of date of manufacture, date of sale and independent of actual time of activation, and to be apprised of elapsed time from such activation, comprising providing an electronic printed chromatic elapsed time indicator device comprising a switch, a power source and a power driven elapsed time display for indicating the elapse of a limited predetermined segment of time upon activation of said switch and irrespective of the actual time of activation thereof, wherein said components are functionally interconnected and are printed on at least one substrate and wherein said switch is adapted to be activated by the consumer at time of use.

* * * * *